United States Patent [19]

Korr et al.

[11] 4,036,141

[45] July 19, 1977

[54] AMMUNITION

[76] Inventors: Abraham L. Korr, 8712 Hickory Drive, Philadelphia, Pa. 19136; Evan Harris Walker, 834 Paradise Road, Aberdeen, Md. 21001; Charles M. Dickey, 3549 Brae Bourn Drive, Huntingdon Valley, Pa. 19006

[21] Appl. No.: 710,493

[22] Filed: Aug. 2, 1976

[51] Int. Cl.[2] ..... F42B 9/02

[52] U.S. Cl. ..... 102/38; 102/40; 102/69; 102/49.5; 102/DIG. 7

[58] Field of Search ..... 102/38, 40, 49.5, 69, 102/91, 92.4, DIG. 7

[56] References Cited

U.S. PATENT DOCUMENTS

| | | | |
|---|---|---|---|
| 911,793 | 2/1909 | Wille | 102/69 |
| 1,284,777 | 11/1918 | Rinehart | 102/69 |
| 3,374,740 | 3/1968 | Voda | 102/49.5 |
| 3,450,050 | 6/1969 | Robinson | 102/92.4 |
| 3,954,060 | 5/1976 | Haag et al. | 102/DIG. 7 |

*Primary Examiner*—Verlin R. Pendegrass
*Attorney, Agent, or Firm*—Nathan Edelberg

[57] ABSTRACT

A hypervelocity ammunition round in which a spin stabilized artillery projectile contains a plurality of subcaliber gun tubes for launching subcaliber spin stabilized projectiles from the artillery projectile at a predetermined point in its trajectory, as the artillery projectile performs as a moving gun platform to more effectively defeat a multiplicity of targets through the kinetic energy impact of the subcaliber projectiles.

9 Claims, 10 Drawing Figures

AMMUNITION

The invention described herein may be manufactured, used and licensed by or for the Government for governmental purposes without the payment to us of any royalty thereon.

This invention relates to ammunition and more particularly, to an ammunition round having a spin stabilized artillery projectile that performs as a moving gun platform.

It is an object of the invention to provide a hypervelocity ammunition round having a maximum capability of defeating a multiplicity of targets through the kinetic energy of the impacting subcaliber projectiles on the targets.

Another object of the invention is to provide such as ammunition round having a maximum of effectiveness capability.

A further object of the invention is to provide such an ammunition round having a maximum of accuracy capability.

These and other objects, features and advantages will become more apparent from the following description and accompanying drawings in which.

Figure 1:
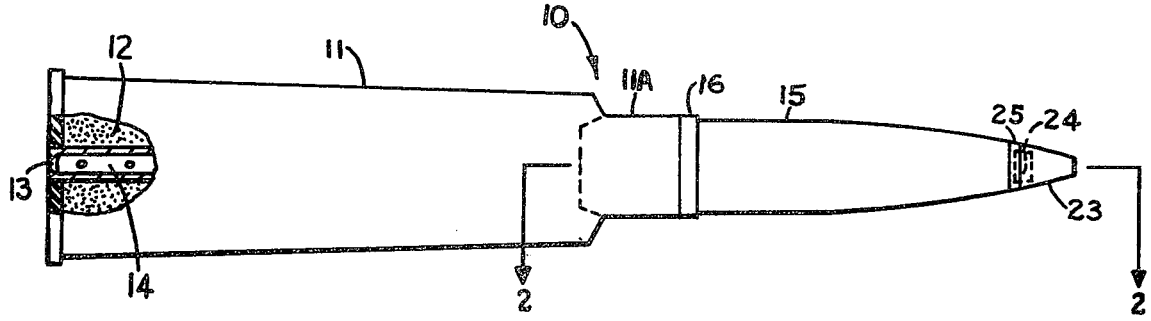
FIG. 1 is a longitudinal elevational view, partially broken away in section, of a preferred ammunition round embodying the principles of the invention.

The hypervelocity artillery ammunition round, shown generally at 10 (FIG. 1), has a cartridge case 11 containing a propellant charge 12 ignitable by an appropriate primer 13, centrally secured in the rearward base portion of the case 11, with a multi-apertured tube 14 extending longitudinally through the charge and by which the latter is in fluid communication with the primer for launching a spin stabilized main projectile 15 from the mouth 11A of the cartridge case in which it is crimpingly secured.

Figure 2:
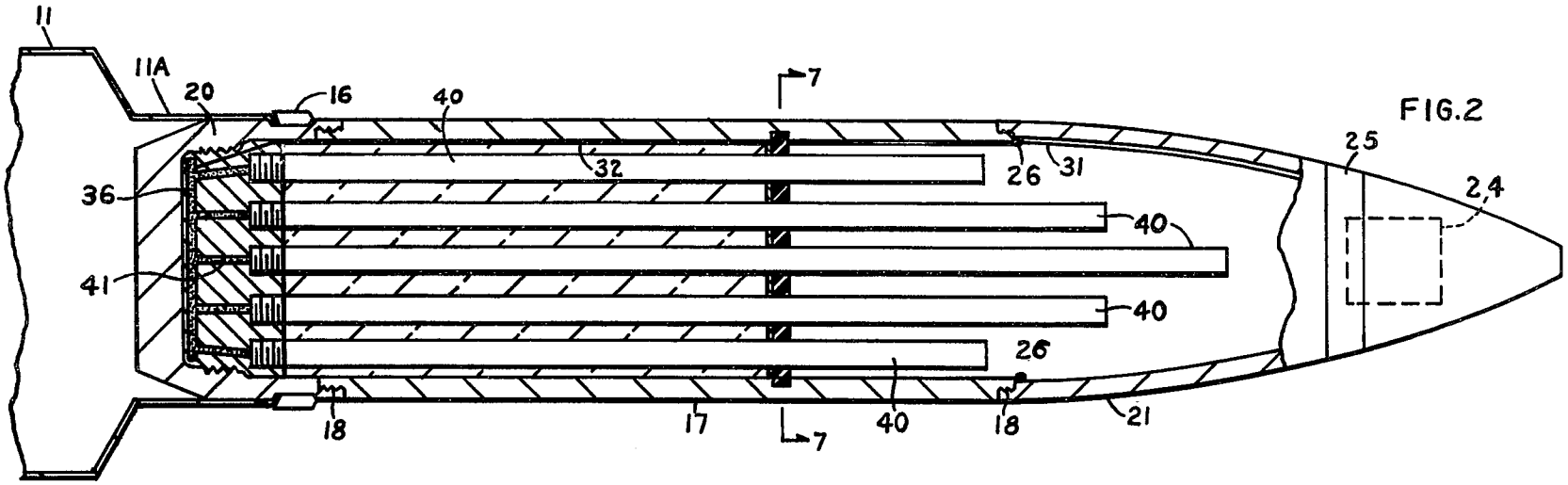
FIG. 2 is an enlarged sectional view taken substantially along line 2—2 of FIG. 1.
Figure 9:
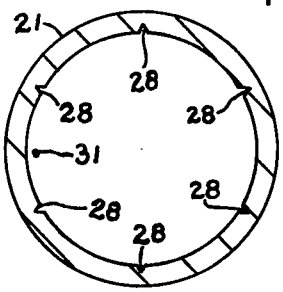
FIG. 9 is a sectional view taken along line 9—9 of FIG. 8.
Figure 8:
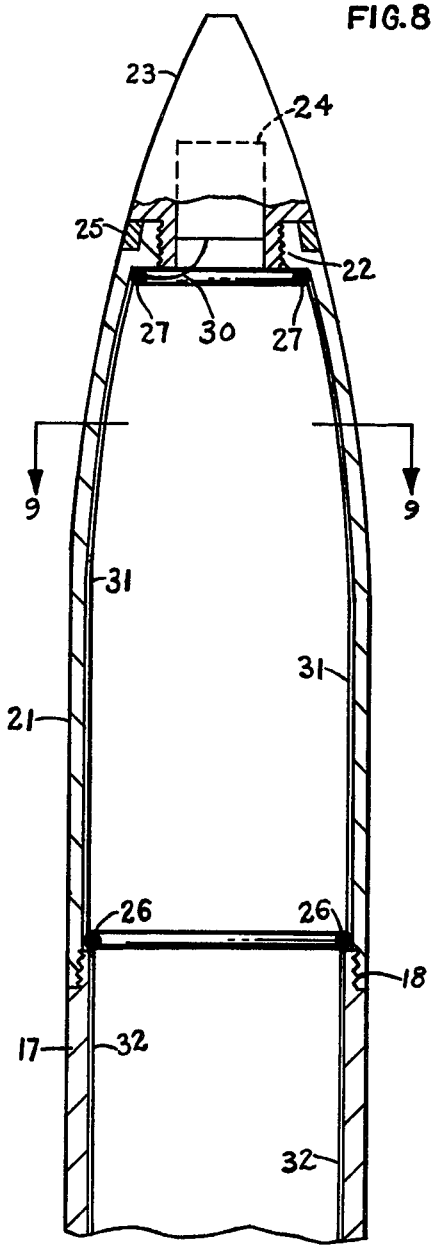
FIG. 8 is an enlarged partial sectional view similar to FIG. 2 with certain parts omitted.
Figure 10:
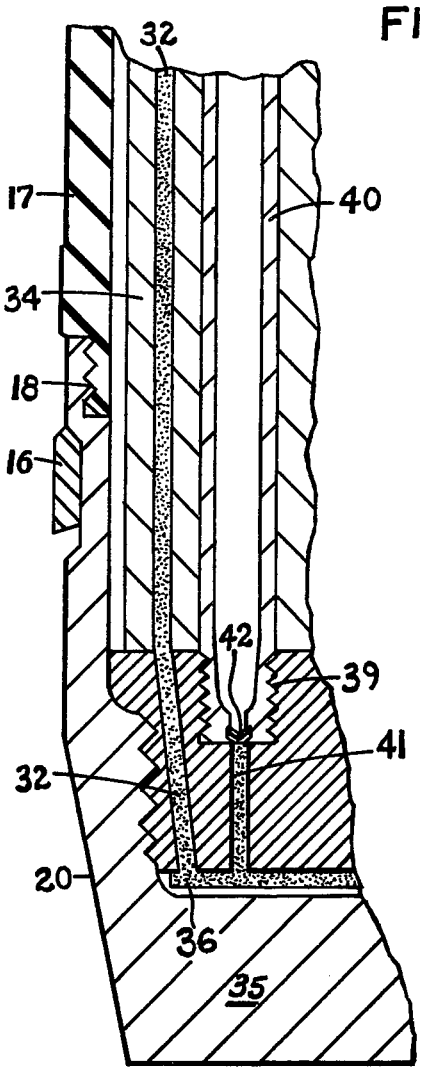
FIG. 10 is an enlarged sectional view of a rearward portion of the FIG. 2 projectile with certain parts omitted.

The projectile 15 preferably has an annular rotating band 16 (FIGS. 1, 2), for obturation and spin imparting engagement with appropriate gun barrel rifling, secured in a suitable recess formed in its peripheral sidewall forwardly adjacent the crimped securement of the cartridge case mouth upon the projectile 15. The main body portion of projectile 15 comprises a hollow cylindrical sidewall 17 (FIGS. 2, 8, 10) having externally threaded reduced annular sleeve portions 18, 18 upon which corresponding portions of the projectile base member 20 and forward ogive portion 21 are matingly secured. The forwardly and inwardly tapering ogive portion 21 terminates with an inwardly offset internally threaded annulus 22 for securement of the forwardmost conically shaped nose member 23 that contains an appropriate timing or proximity fuze 24. A suitble snap ring adapter 25 strenghthens the nose connection and provides a mating smooth or continuous forward external surface. Adjacent the ends of ogive portion 21, corresponding annular rings of Primacord 26, 27 (FIG. 8) are adhesively secured in transverse positions upon the ogive internal surface that is provided with a plurality of circumferentially spaced serrations of pre-formed grooves 28 (FIG. 9) that extend longitudinally between and substantially normal to the longitudinally spaced Primacord annular rings 26, 27. The smaller and forwardmost Primacord ring 27 is connected to fuze member 24 by a pyrotechnic ignition line 30 and to the larger Primacord ring 26 by Primacord or pyrotechnic ignition line 31 which extends longitudinally along and is adhesively secured to the inner surface of ogive portion 21.

After projectile launch and a predetermined period of operational or trajectory flight the timing or proximity fuze, through energy transfer or pyrotechnic ignition line 30, will initiate the fuze ejection element or Primacord ring 27 to circumferentially detonate the latter and rupture the adjacent sidewall of ogive portion 21 rearwardly adjacent ring adapter 25 to eject or discard the fuze nose 23 and associated parts. Simultaneous with the continued ignition or controlled burning of energy transfer or pyrotechnic line 31, the serrated or preweakened sidewall of ogive portion 21 will tend to break away in response to centrifugal forces and the forces of the passing or traversed pressure fluid, to assist the ogival ejection element or Primacord ring 26 in ejecting or discarding the ogive portion 21 as the sidewall adjacent detonated ring 26 is circumferentially ruptured.

Extending rearwardly of and interconnecting with the ogival ejection element 26 is a similar pyrotechnic, Primacord or energy transfer line 32 (FIGS. 2, 7, 8, 10) that extends longitudinally along the internal surface of cylindrical sidewall 17 (to which it is adhesively secured), through a small opening in transverse steel of metallic support plate 33, molded epoxy or equivalent plastic body 34, and through a passageway in a steel base support 35, where it connects with an explosive initiator or sheet 36 of Hivelite, Amolite or equivalent fast burning rate propellant that is adhesively secured to the rearward face of base support 35.

Base support 35 is threadedly mounted in projectile base member 20 and has a plurality of laterally spaced forwardly opening tapped recesses 39 in its forward surface for threaded securement of corresponding subcaliber launch tubes 40 (FIGS. 2, 3, 7, 10) that extend longitudinally and parallel to each other through the molded body 34 and the forwardly adjacent multi-apertured support plate 33. The base of each recess 39 in the base support 35 has a small rearwardly extending longitudinal passage containing a corresponding one of the short parallel pyrotechnic, Primacord or energy transfer lines 41 that operatively interconnect the explosive sheet 36 with a respective primer 42 centrally positioned in the rearward end of each launch tube 40.

Figure 4:
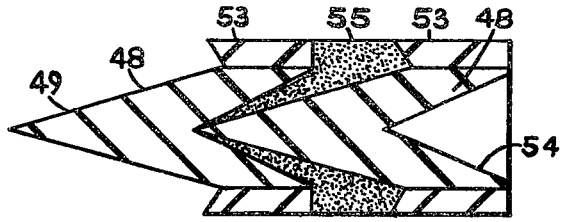
FIG. 4 is an enlarged partial sectional view of successive tandem mounted subcaliber projectiles positioned in the gun tube of FIG. 3.
Figure 5:
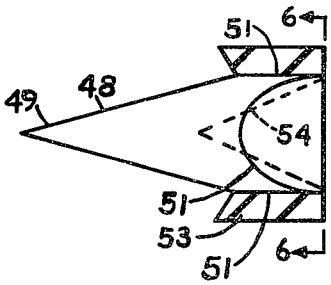
FIG. 5 is an elevational view of one of the FIG. 4 subcaliber projectiles with its rotating band broken away in section.
Figure 6:
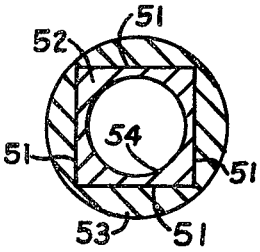
FIG. 6 is a sectional view taken along line 6—6 of FIG. 5.
Figure 7:
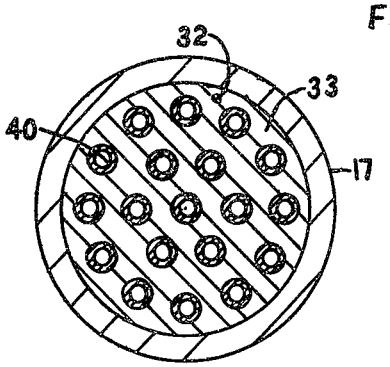
FIG. 7 is an enlarged sectional view taken along line 7—7 of FIG. 2.
Figure 3:
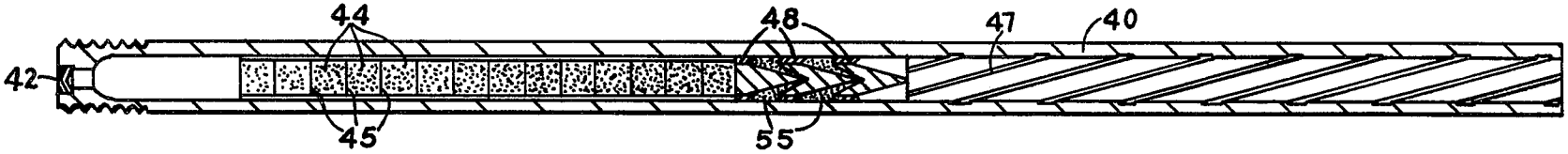
FIG. 3 is an enlarged sectional view of one of the subcaliber gun tubes shown in FIG. 2.

Each subcaliber launch tube 40 contains a plurality of tandemly mounted traveling charge elements 44 (FIG. 3) of an end burning type and fast burning rate propellant, longitudinally adjacent pairs of charge elements 44 being separated by a charge separator 45 of a relatively slower burning rate material. Each rearmost one of the corresponding longitudinal series of sequentially initiated propellant charges 44 is located proximate the corresponding primer 42 in a rearward portion of the respective launch tube 40. The forward portion of each launch tube 40 has appropriate internal rifling groove means 47 to impart spin to the plurality of tandemly mounted sub-projectiles (FIGS. 3, 4, 5). Each sub-projectile 48 is a spin stabilized conical steel or other metallic element having a conically shaped external surface portion 49 provided with four equally spaced longitudinally extending flats 51 (FIGS. 5, 6) that define two opposed pairs of parallel hyperbolic lateral surfaces, each surface extending in a plane substantially normal to the planes containing the other opposed pair of parallel hyperbolic shaped flats 51 and normal to the projectile base 52. A mating discardable sabot-type, molded rotating band 53 surrounds the flat surfaces 51 and rearmost conical surface portions 50 of each sub-projectile 48 and is secured thereto with a press fit. The base or rearward surface of each conical sub-projectile 48 has a conical recess 54 defining an internal conical surface portion with a longitudinal taper that is inclined relative to the forward external conical surface portion 49 which has lesser degree of taper.

Preferably during a molding operation, a series or group of successive tandemly positioned conical sub-projectiles 48, with their rotating bands 53 attached, are arranged such that each longitudinally adjacent pair of sub-projectiles 48 (FIG. 4) are in an abutting relationship with external conical nose point of one sub-projectile in contact with the central point of the conical recess of the next forward sub-projectile. In this position within an appropriate mode, the annular space between opposing inclined conical face portions of each abutting pair of sub-projectiles is filled with an annular molded propellant body 55 of Hivelite or other very high burning rate propellant. The cylindrical outer surface of each propellant body 55 is substantially equal to the external diameter of the corresponding rotating bands 53, between the respective forward and rearward surfaces of which the propellant annulus 55 extends. As each forwardmost propellant body 55, of the respective forwardly moving group of tandem sub-projectiles 48 upon initiation of charges 44, is ignited by frictional contact with the corresponding rifled subcaliber launch tube, the ignition thereby will increase the velocity of the corresponding forwardmost sub-projectile and separate each forwardmost sub-projectile from its tandem group. Successive ignitions of the next rearward propellant bodies 55, will similarly separate the corresponding next rearward sub-projectiles.

As the Primacord ring 26 detonates to eject or discard the ogive portion 21 as hereinbefore described to present a moving gun platform, the pyrotechnic line 32 continues to burn and thereby detonate the explosive sheet 36, whereupon the short Primacord lines 41 will substantially simultaneously ignite each of subcaliber launch tube primers 42 and thus initiate the rearmost one of each series of traveling charges 44. In this manner an array of launched sub-projectiles 48 is launched from the corresponding subcaliber launch tubes 40 of the spinning in-flight platform.

Various modifications, changes or alterations may be resorted to without departing from the scope of the invention as defined in the appended claims.

We claim:

1. In an ammunition round having a projectile secured in a mouth of a cartridge case, said case having means for operatively launching said projectile, said projectile having a main body portion and a forward ogive portion, said ogive portion having a forwardmost nose member containing fuze means, an ogival ejection element carried by a rearward portion of said ogive portion, ignition means interconnecting said ogival ejection element with said fuze means, a plurality of launch tubes secured in a base support positioned in said projectile main body portion, each launch tube carrying a plurality of sub-projectiles, a rearmost primer, and a plurality of sequentially initiated traveling charges intermediate said sub-projectiles and said primer, an initiator secured in a base portion of said projectile main body portion, and ignition means interconnecting said initiator with said ogival ejection element and each of said launch tube primers.

2. The structure in accordance with claim 1 wherein each of said sub-projectiles is a spin stabilized conical element.

3. The structure according to claim 2 wherein said projectile contains means laterally spacing said launch tubes from each other.

4. The structure of claim 3 wherein said laterally spacing means includes a multi-apertured support plate and a molded support body intermediate said support plate and said base support, said launch tubes extending through said molded support body.

5. The structure of claim 4 wherein each of said launch tubes has internal rifling grooves for operationally imparting spin to its corresponding sub-projectiles.

6. The structure of claim 5 wherein each of said conical sub-projectiles has internal and external conically shaped surface portions, the taper of the internal and external surface portions being inclined relative to each other.

7. The structure of claim 6 wherein the sub-projectiles in each launch tube are mounted in tandem, and propellant means disposed between opposing face portions of each pair of successive tandemly mounted sub-projectiles.

8. The structure of claim 1 wherein said traveling charges in each launch tube are sequentially initiated tandemly mounted propellant charges.

9. The structure of claim 1 wherein said ogive portion has a nose fuze ejection element longitudinally spaced from and forward of said ogive ejection element.

* * * * *